US006192873B1

(12) United States Patent
Adachi et al.

(10) Patent No.: US 6,192,873 B1
(45) Date of Patent: Feb. 27, 2001

(54) IGNITION COIL HAVING SPRING FOR CONNECTING THE SAME TO SPARK PLUG

(75) Inventors: Norihiro Adachi, Kariya; Kazutoyo Osuka, Gamagori, both of (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 09/419,899

(22) Filed: Oct. 18, 1999

(30) Foreign Application Priority Data

Oct. 22, 1998 (JP) ..... 10-300926

(51) Int. Cl.[7] ..... H01F 27/28

(52) U.S. Cl. ..... 123/635; 123/634; 123/189 PA; 439/127

(58) Field of Search ..... 123/635, 634, 123/169 PA, 169 PH; 439/125, 127, 128; 336/107

(56) References Cited

U.S. PATENT DOCUMENTS

| | | | | |
|---|---|---|---|---|
| 5,170,767 | * | 12/1992 | Wada et al. | 123/634 |
| 5,340,323 | * | 8/1994 | Imanishi et al. | 439/125 |
| 5,458,509 | * | 10/1995 | Hiraoka et al. | 439/125 |
| 5,537,983 | * | 7/1996 | Nakajima | 123/635 |
| 5,679,012 | * | 10/1997 | Murata | 439/125 |
| 5,682,865 | * | 11/1997 | Maekawa et al. | 123/635 |
| 5,827,079 | * | 10/1998 | Murata | 439/125 |

FOREIGN PATENT DOCUMENTS

| | | |
|---|---|---|
| 0 508 374 | 10/1992 | (EP) . |
| 0 738 831 | 10/1996 | (EP) . |
| 0 796 993 | 9/1997 | (EP) . |
| 6-251963 | 9/1994 | (JP) . |
| 10-303045 | 11/1998 | (JP) . |

* cited by examiner

*Primary Examiner*—Henry C. Yuen
*Assistant Examiner*—Hieu T. Vo
(74) *Attorney, Agent, or Firm*—Nixon & Vanderhye PC

(57) ABSTRACT

A stick-type ignition coil to be directly connected to a spark plug via a spring. A high tension case containing a high tension terminal and a spring is integrally connected to the bottom end of a high tension generating portion of the ignition coil. The high tension terminal and the spring are separately supported in the high tension case before the spark plug is connected to the ignition coil. When the spark plug is connected, the spring is compressed and contacts the high tension terminal, thereby making electrical contact between the ignition coil and the spark plug. Since the spring and the high tension terminal are supported on separate positions in the case, the spring can be properly compressed without being distorted or jammed between the high tension terminal and the case.

16 Claims, 3 Drawing Sheets

IGNITION COIL HAVING SPRING FOR CONNECTING THE SAME TO SPARK PLUG

CROSS-REFERENCE TO RELATED APPLICATION

This application is based upon and claims benefit of priority of Japanese Patent Application No. Hei-10-300926 filed on Oct. 22, 1998, the content of which is incorporated herein by reference.

BACKGROUND OF THE INVENTION

1. Field of the Invention

The present invention relates to an ignition coil, a high tension terminal of which is electrically connected to a spark plug via a spring.

2. Description of Related Art

It is generally known to directly connect a stick-type ignition coil to a spark plug via a spring to make electrical connection therebetween. A high tension case containing a high tension terminal and a spring is connected to a bottom end of an ignition coil. Both the high tension terminal and the spring are assembled and supported in the case before the ignition coil is connected to the spark plug. When the ignition coil is connected to the spark plug, the spring is compressed and contacts the high tension terminal, thereby making electrical connection between the ignition coil and the spark plug. Since the high tension terminal and the spring are supported at the same position in the case, there is a possibility that the spring is jammed between the high tension terminal and the case when the spring is compressed. If that happens, the spring is improperly deformed and may be broken.

SUMMARY OF THE INVENTION

The present invention has been made in view of the above-mentioned problem, and an object of the present invention is to provide an improved ignition coil in which the spring and the high tension terminal are separately supported in the high tension case before the ignition coil is connected to the spark plug, and the spring is properly compressed when the ignition coil is connected to the spark plug, thereby avoiding the spring from being jammed between the high tension terminal and the case.

A stick-type ignition coil is composed of a high tension generating portion and a high tension case in which a high tension terminal connected to the high tension generating portion and a spring for electrically connecting the ignition coil to a spark plug are housed. The high tension case is made of resin and integrally connected to the bottom part of the high tension generating portion. The high tension case is generally cylinder-shaped and includes a boss formed therein for supporting the high tension terminal and the spring.

In the process of assembling the high tension case, the spring is first inserted into the high tension case and then the high tension terminal is inserted. Both the spring and the high tension terminal are designed so that the they can be assembled to the high tension case from the upper opening thereof. A first shoulder for supporting the high tension terminal thereon and a second shoulder for supporting the spring thereon are formed on the supporting boss. The spark plug is connected to the ignition coil by inserting the spark plug into the high tension case from the bottom opening thereof. When the spark plug is inserted, the spring is compressed by the spark plug and contacts the high tension terminal, thus making electrical connection for supplying high tension to the spark plug. In short, the spring is held in the high tension case at an axially separate position from the high tension terminal before the spark plug is inserted, and the spring is compressed and contacts the high tension terminal when the spark plug is inserted into the high tension case.

Thus, the spring is properly compressed without being distorted or jammed between the high tension terminal and the high tension case when the spark plug is connected to the ignition coil. In addition, both of the spring and the high tension terminal can be inserted into the high tension case from the same direction in the assembling process, thereby simplifying the assembling process.

The supporting boss may be designed so that the high tension terminal is inserted into the inner bore of the supporting boss. Alternatively, the supporting boss is designed so that the high tension terminal is disposed to fit the outer cylindrical surface of the supporting boss. The axial positions of the first and second shoulders in the high tension case are arbitrarily selected, as long as they are separately positioned.

Other objects and features of the present invention will become more readily apparent from a better understanding of the preferred embodiments described below with reference to the following drawings.

DETAILED DESCRIPTION OF THE PREFERRED EMBODIMENTS (First Embodiment)

Figure 1:
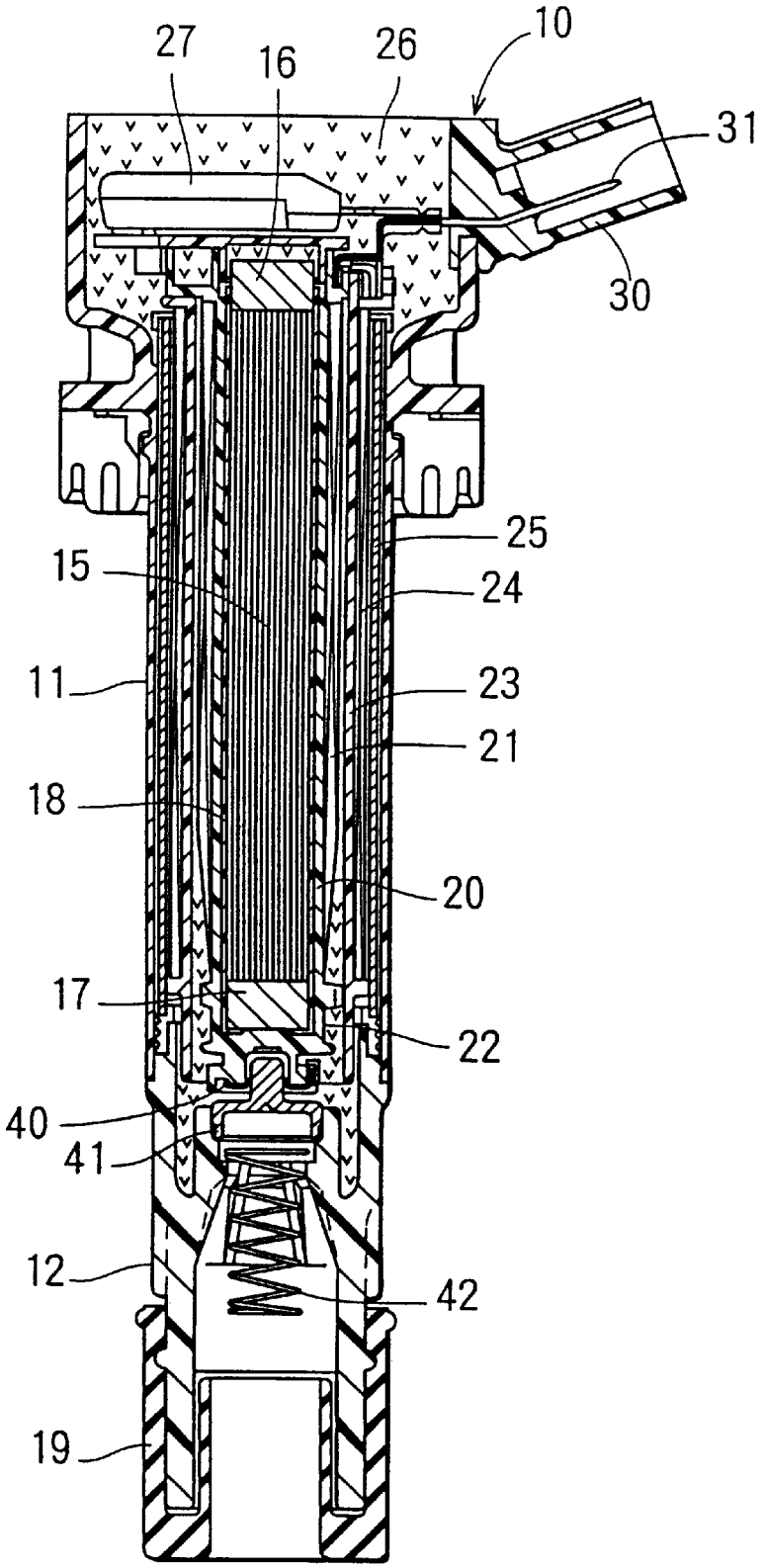
FIG. 1 is a cross-sectional view showing an stick-type ignition coil to be connected to a spark plug via a spring.

A first embodiment of the present invention will be described with reference to FIGS. 1 and 2. First, referring to FIG. 1, the whole structure of an ignition coil 10 will be described. The ignition coil 10 is inserted into a hole that is formed on an engine block for each cylinder and is electrically and mechanically connected to a spark plug at the bottom portion thereof. The coil 10 includes an elongate cylindrical coil case 11 and high tension case 12, both being made of resin. In the coil case 11, components for generating high voltage are housed. They are: an inner core 15, a pair of permanent magnets 16, 17, a secondary spool 20, a secondary coil 21, a primary spool 23, a primary coil 24, an outer core 25, etc. Epoxy resin 26 fills spaces between those components and other spaces inside the ignition coil 10 for enhancing insulation among the components.

The inner core 15 is made by laminating thin silicon steel plates, forming an elongate cylindrical shape. The permanent magnets 16, 17 are positioned at both ends of the inner core 15 and magnetized in the direction opposite to the direction of magnetic field generated by the primary coil 24. The outer cylindrical surface of the inner core 15 is covered by the insulating rubber tube 18. The secondary spool 20 made of resin is disposed outside of the rubber tube 18, and the secondary coil 21 is wound around the secondary spool 20. A dummy coil 22 having one turn and connecting the secondary coil 21 to a terminal plate 40 is positioned at the bottom end of the secondary coil 21. By connecting the secondary coil 21 to the terminal plate 40 with the dummy coil 22, a large electrically contacting surface therebetween is secured, and thereby concentration of electric field is avoided.

The primary spool 23 made of resin is disposed outside of the secondary coil 21, and the primary coil 24 is wound around the primary spool 23. The outer core 25 formed by rolling a thin silicon steel plate is disposed outside of the primary coil 24. Since the edges of the rolled steel plate are not connected to the core body, there are some longitudinal gaps. The outer core 25 covers a whole length between both permanent magnets 16, 17 positioned at both longitudinal ends of the inner core 15. A connector 30 is disposed at the upper end of the ignition coil 10, so that it extends outwardly from the plug hole when the ignition coil 10 is installed in the plug hole. An ignitor 27 for switching current supplied to the primary coil 24 is disposed in the upper portion of the coil case 11. Plural terminals 31 for feeding control signals to the ignitor 27 and for connecting ground terminals of the primary and secondary coils 24, 21 are inserted in the connector 30.

A high tension terminal 41 is press-fitted into the upper center of the high tension case 12 made of resin. A center projection of the high tension terminal 41 is tightly inserted into the terminal plate 40 to electrically connect the high tension terminal 41 to the secondary coil 21 via the terminal plate 40. A high tension end of the dummy coil 22 is electrically connected to the terminal plate 40 by fusing or soldering. A spring 42 is disposed underneath the high tension terminal 41, so that the spark plug and the high tension terminal 41 are electrically connected when the ignition coil 10 is connected to the spark plug. A plug cap 19 made of rubber, into which the spark plug is inserted, is disposed at the bottom end of the high tension case 12. A high voltage generated in the secondary coil 21 by switching the current supplied to the primary coil 24 is imposed on the spark plug via the dummy coil 22, the terminal plate 40, the high tension terminal 41 and the spring 42.

Figure 2:
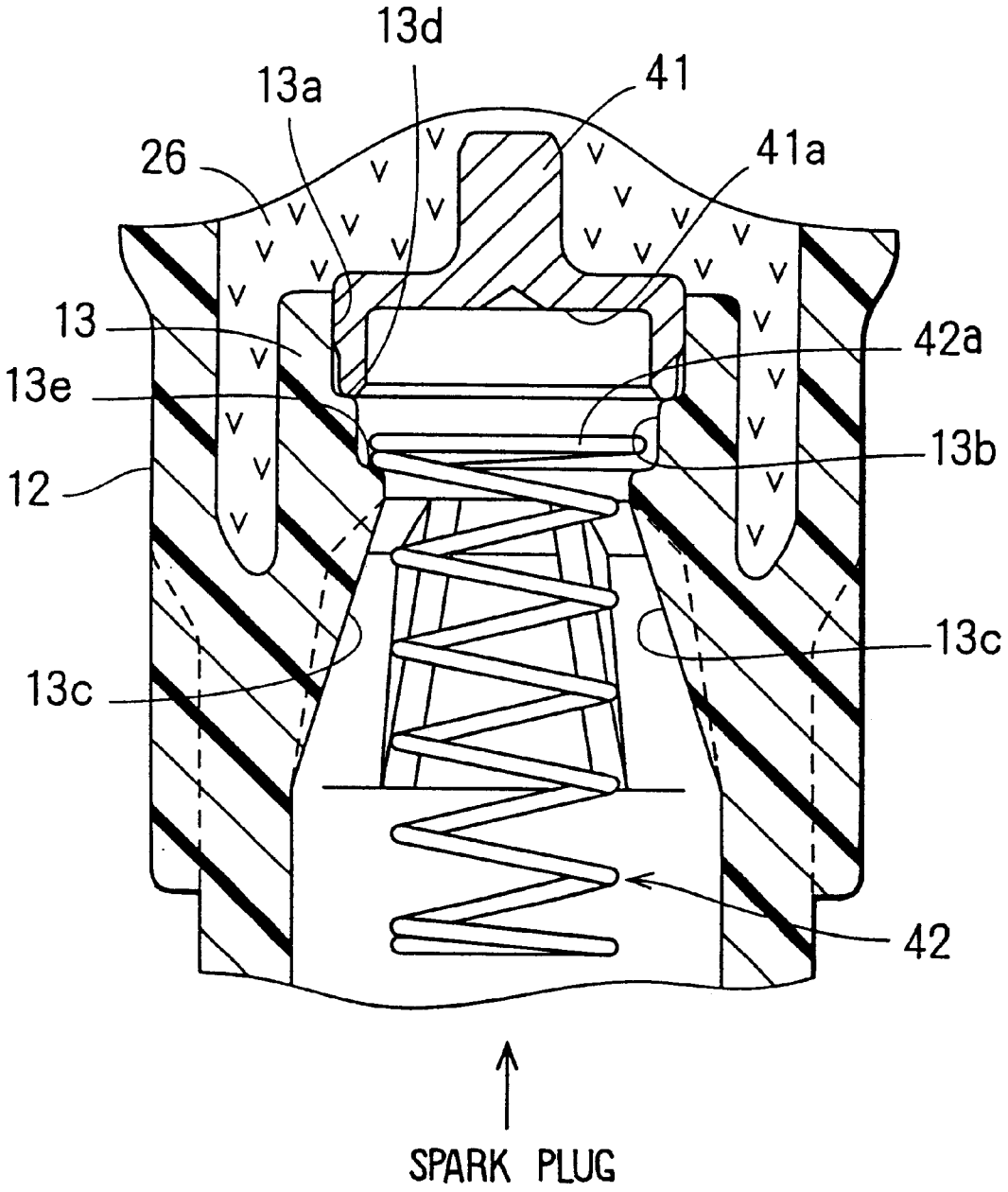
FIG. 2 is a cross-sectional view showing a bottom portion of the ignition coil, as a first embodiment of the present invention.

Referring to FIG. 2, the structure of the high tension case 12, in which the high tension terminal 41 and the spring 42 are housed, will be described in detail. The high tension case 12 is made of resin and generally cylinder-shaped. A supporting boss 13 extending upward is formed in the high tension case 12. The supporting boss 13 includes a large bore 13*a*, a small bore 13*b* and ribs 13*c* formed in this order from the top. A first shoulder 13*d* is formed at the boundary of the large bore 13*a* and the small bore 13*b*, and a second shoulder 13*e* is formed at the boundary of the small bore 13*b* and the ribs 13*c*. The ribs 13*c* are tapered so that its inner diameter is enlarged toward the bottom end of the high tension case 12. In the assembling process, the spring 42 is first inserted into the high tension case 12 from its upper opening and rests on and supported by the second shoulder 13*e*. Then, the high tension terminal 41 is press-fitted into the large bore 13*a* until it abuts the first shoulder 13*d*. The spring 42 includes a spring end 42*a* having an enlarged diameter which rests on the second shoulder 13*e*. The outer diameter of the spring 42 itself except the enlarged end 42*a* is made so that the spring 42 can be freely inserted into the high tension case 12 from its upper opening.

The high tension terminal 41 has a depressed inner space 41*a*. When a spark plug is inserted into the high tension case 12 from its bottom opening, the spring 42 is compressed and pushed up toward the inner space 41*a* until the spring 42 contacts the high tension terminal 41. Because the outer diameter of the spring end 42*a* is smaller than the inner diameter of the inner space 41*a*, the spring end 42*a* can move upward. Thus, the spark plug is electrically connected to the high tension terminal 41 via the spring 42.

Since the high tension terminal 41 and the spring 42 are separately supported in the high tension case 12 when they are assembled, and the spring 42 is compressed and moves into the inner space 41*a* to contact the high tension terminal 41 when the spark plug is inserted into the high tension case 12, the spring 42 never be jammed between the high tension terminal 41 and the high tension case 12. Therefore, the spring 42 is properly compressed without being distorted or damaged by the force generated by inserting the spark plug into the high tension case 12. In addition, there is no such a chance that the spring 42 drops off from the high tension case 12 before the plug is inserted, because the spring 42 is supported on the second shoulder 13*e*. Moreover, the spring 42 and the high tension terminal 41 can be assembled into the high tension case 12 from the same direction, namely, from the upper opening of the high tension case 12. Accordingly, the assembling process can be simplified and easily automated.

(Second Embodiment)

Figure 3:
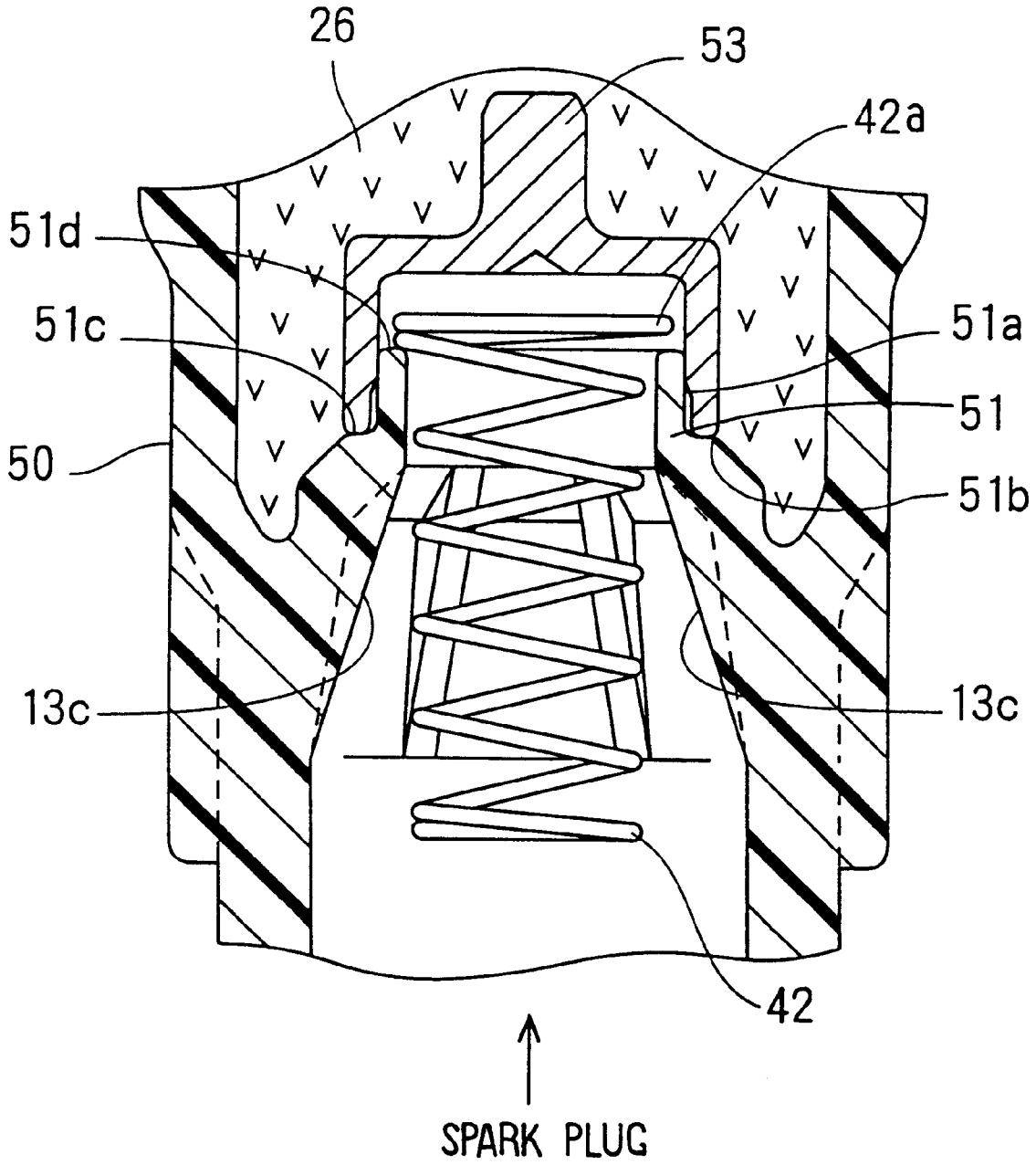
FIG. 3 is a cross-sectional view showing a bottom portion of the ignition coil, as a second embodiment of the present invention.

A second embodiment of the present invention will be described with reference to FIG. 3. This embodiment is similar to the first embodiment except that the high tension terminal is press-fitted to the outer surface of the supporting boss and that the second shoulder is formed on the top end of the supporting boss. Parts and components that are same as those of the first embodiment are denoted with the same reference numbers, and the explanation thereof is not repeated here.

A supporting boss 51 is formed in a high tension case 50 that is generally cylinder-shaped. The supporting boss 51 includes a cylindrical wall 51*a* and a tapered wall 51*b*. A first shoulder 51*c* is formed at the boundary of the cylindrical wall 51*a* and the tapered wall 51*b*, and a second shoulder 51*d* is formed at the top end of the cylindrical wall 51*a*. The ribs 13*c* are formed in the similar manner as in the first embodiment. In the assembling process, the spring 42 having the enlarged spring end 42*a* is first inserted into the supporting boss 51 and supported on the second shoulder 51*d*. Then, a high tension terminal 53 is press-fitted to the outer cylindrical surface of the cylindrical wall 51*a* until it abuts the first shoulder 51*c*. The outer diameter of the spring 42 except the enlarged end 42*a* is made smaller than the inner diameter of the cylindrical wall 51*a*, so that the spring 42 can be inserted into the supporting boss 51 from the upper opening thereof. The enlarged diameter of the spring end 42*a* is larger than the inner diameter of the cylindrical wall 51*a* and smaller than the inner diameter of the high tension terminal 53. When a spark plug is inserted into the high tension case 50 from its bottom opening, the spring 42 is compressed and contacts the high tension terminal 53, thereby electrically connecting the spark plug and the high tension terminal 53.

Since the high tension terminal 53 and the spring 42 are supported on the respectively different positions in the high tension case 50, the spring 42 never be jammed between the high tension case 50 and the high tension terminal 53 when the spring 42 is compressed to contact the high tension terminal 53. The same advantages as those of the first embodiment are realized in the second embodiment, too.

The present invention is also applicable to other ignition coils than the stick-type ignition coil described above, as long as the ignition coils are of the type to be electrically connected to a spark plug via a spring.

While the present invention has been shown and described with reference to the foregoing preferred embodiments, it will be apparent to those skilled in the art that changes in form and detail may be made therein without departing from the scope of the invention as defined in the appended claims.

What is claimed is:

1. An ignition coil comprising:

a high tension generating portion;

a high tension case connected to a bottom end of the high tension generating portion;

a high tension terminal fixed in the high tension case and electrically connected to the high tension generating portion;

a spring including an end portion having an enlarged diameter, the spring being housed in the high tension case, wherein:

the high tension case includes means for separately supporting the high tension terminal and the end portion of the spring when the high tension terminal and the spring are assembled in the high tension case; and the spring is compressed and contacts the high tension terminal when a spark plug is inserted into the high tension case, thereby making electrical contact between the spark plug and the high tension terminal via the spring.

2. The ignition coil as in claim 1, wherein:

the separately supporting means comprises a first shoulder for supporting the high tension terminal thereon and a second shoulder for supporting the enlarged end of the spring thereon, both shoulders being located at different positions in a longitudinal direction of the high tension case.

3. The ignition coil as in claim 2, wherein:

the second shoulder is located closer to the spark plug to be inserted into the high tension case than the first shoulder.

4. The ignition coil as in claim 2, wherein:

the first shoulder is located closer to the spark plug to be inserted into the high tension case than the second shoulder.

5. The ignition coil as in claim 3, wherein:

the first and second shoulders are formed in an inner bore of a supporting boss formed in the high tension case, the supporting boss extending in the longitudinal direction of the high tension case.

6. The ignition coil as in claim 4, wherein:

the first shoulder is formed on an outer periphery of a supporting boss formed in the high tension case, the supporting boss extending in the longitudinal direction of the high tension case; and the second shoulder is formed on an upper end of the supporting boss.

7. An ignition coil comprising:

a high tension generating portion;

a high tension case connected to a bottom end of the high tension generating portion;

a high tension terminal mounted in the high tension case and electrically connected to the high tension generating portion;

a spring including an end portion having an enlarged diameter, the spring being housed in the high tension case, wherein:

the high tension case includes a first support for supporting the high tension terminal and a second support for supporting said enlarged diameter end portion of said spring when the high tension terminal and the spring are assembled in the high tension case, said first support being at least one of axially and laterally offset with respect to said second support; and the spring is compressed and contacts the high tension terminal when a spark plug is inserted into the high tension case, thereby making electrical contact between the spark plug and the high tension terminal via the spring.

8. The ignition coil as in claim 7, wherein:

said first support comprises a first shoulder for supporting the high tension terminal thereon and said second support comprises a second shoulder for supporting the enlarged end of the spring thereon.

9. The ignition coil as in claim 8, wherein said first and second shoulders are offset in a longitudinal direction of the high tension case.

10. The ignition coil as in claim 9, wherein the second shoulder is located closer to the spark plug to be inserted into the high tension case than the first shoulder.

11. The ignition coil as in claim 9, wherein:

the first shoulder is located closer to the spark plug to be inserted into the high tension case than the second shoulder.

12. The ignition coil as in claim 7, wherein a supporting boss is defined in said high tension case, said supporting boss having an inner bore, and wherein at least one of said first and second supports is formed in the inner bore of said supporting boss.

13. The ignition coil as in claim 12, wherein said first support comprises a first shoulder formed on an outer periphery of said supporting boss.

14. The ignition coil as in claim 12, wherein an upper end of said supporting boss defines said second support.

15. An ignition coil as in claim 7, wherein said high tension terminal engages a supporting boss defined in an interior of the high tension case.

16. An ignition coil as in claim 7, wherein said enlarged end portion of said spring is disposed adjacent said high tension terminal whereby when a spark plug is inserted into the high tension case, said enlarged end portion of said spring contacts the high tension terminal.

* * * * *